US008857951B2

(12) United States Patent
Song et al.

(10) Patent No.: US 8,857,951 B2
(45) Date of Patent: Oct. 14, 2014

(54) LARGE-FORMAT INKJET PRINTING APPARATUS

(75) Inventors: Yanlin Song, Beijing (CN); Jianguo Yang, Beijing (CN); Ke Xiao, Beijing (CN)

(73) Assignee: Beijing Zhongke Nano-Think Print Technology Co., Ltd., Beijing (CN)

( * ) Notice: Subject to any disclaimer, the term of this patent is extended or adjusted under 35 U.S.C. 154(b) by 0 days.

(21) Appl. No.: 13/583,615

(22) PCT Filed: May 19, 2010

(86) PCT No.: PCT/CN2010/072945

§ 371 (c)(1), (2), (4) Date: Nov. 5, 2012

(87) PCT Pub. No.: WO2011/109955

PCT Pub. Date: Sep. 15, 2011

(65) Prior Publication Data

US 2013/0057612 A1 Mar. 7, 2013

(30) Foreign Application Priority Data

Mar. 9, 2010 (CN) ..... 2010 1 0123178

(51) Int. Cl.

| | |
|---|---|
| ***B41J 2/15*** | (2006.01) |
| ***B41J 11/00*** | (2006.01) |
| ***B41J 3/28*** | (2006.01) |
| ***B41J 3/54*** | (2006.01) |

(52) U.S. Cl.

CPC ..... *B41J 3/543* (2013.01); *B41J 11/0085* (2013.01); *B41J 3/28* (2013.01); *B41J 11/001* (2013.01)

USPC ..... 347/37

(58) Field of Classification Search

CPC ..... B41J 3/54; B41J 25/005; B41J 2/51; B43L 13/24

USPC ..... 347/37

See application file for complete search history.

(56) References Cited

U.S. PATENT DOCUMENTS

| | | | | |
|---|---|---|---|---|
| 5,598,192 | A * | 1/1997 | Burger et al. | 347/40 |
| 2001/0024215 | A1* | 9/2001 | Usui et al. | 347/37 |
| 2002/0114652 | A1* | 8/2002 | Morozumi et al. | 400/82 |
| 2002/0122093 | A1* | 9/2002 | Otsuka | 347/37 |
| 2006/0164461 | A1* | 7/2006 | Rogers | 347/37 |
| 2008/0100663 | A1* | 5/2008 | Lee et al. | 347/40 |
| 2009/0040269 | A1* | 2/2009 | Nakajima et al. | 347/37 |
| 2009/0102879 | A1* | 4/2009 | Katada et al. | 347/85 |
| 2009/0115805 | A1* | 5/2009 | Yoshida et al. | 347/9 |
| 2010/0073424 | A1* | 3/2010 | Mills et al. | 347/37 |
| 2010/0087945 | A1* | 4/2010 | Nakajima et al. | 700/105 |

* cited by examiner

*Primary Examiner* — Shelby Fidler

(74) *Attorney, Agent, or Firm* — Raymond Y. Chan; David and Raymond Patent Firm

(57) ABSTRACT

A large-format printing apparatus includes multiple printing head units. Each of the printing head units can intermittently and steppingly move in a first direction and has a printing nozzle which can move reciprocatingly in a second direction which is perpendicular to the first direction for printing sub-images. Before printing starts, the printing head units are disposed at one end of a printing medium, and arranged to seamlessly splice the sub-images printed by the printing head units into a complete large-format printing image.

13 Claims, 7 Drawing Sheets

LARGE-FORMAT INKJET PRINTING APPARATUS

BACKGROUND OF THE PRESENT INVENTION

1. Field of Invention

The present invention relates to a printing apparatus, and more particularly to a large-format inkjet printing apparatus which comprises a plurality of printing head units for facilitating large-format printing on a plurality of printing zones.

2. Description of Related Arts

Conventional printers printing on A4 size papers can achieve a high resolution of 5760 dpi×1440 dpi. For large-format printing, however, the conventional printers can only achieve a resolution of 2880 dpi×1440 dpi. The main reason for this limitation is that conventional manufacturing processes for the printing head units of the large-format printers are very complicated, and it is very difficult for a large-format printer to achieve high resolution without jeopardizing high printing speed. This is the main reason why conventional large-format printers are far more expensive than regular small-format printers.

Thus, there is a need to have a large-format inkjet printing apparatus having high printing resolution and high printing speed.

SUMMARY OF THE PRESENT INVENTION

The invention is advantageous in that it provides a large-format printing apparatus which comprises a plurality of printing head units for accomplishing the large-format printing by splicing the sub-images into a complete large-format image. Accordingly, the present invention not only can print various sizes of the large-format image and medium to be printed, but also can substantially enhance the printing speed for a large-format printing job as compared to conventional large-format printers.

According to the present invention, the foregoing and other objects and advantages are attained by providing a large-format printing apparatus, comprising a plurality of printing head units arranged to be driven to move periodically and steppingly in a first direction, wherein each of the printing head units comprises a printing nozzle arranged to move reciprocatingly in a second direction for printing sub-images within an interval between two steps of the movement of the printing head units in the first direction, wherein the first direction is perpendicular to the second direction, wherein the printing head units are positioned at one end portion of the printing medium, while each of the printing head units is arranged to print on a predetermined printing zone to form a sub-image, wherein each of the sub-images is arranged to be combined seamlessly with the adjacent sub-image to form a large-format printed image.

Each of the printing head units is a printing head unit of a small-format printing apparatus.

Each of the printing head units is positioned on a top edge portion of the printing medium along a first direction thereof so that the large-format image is divided into a plurality of elongated printing zones along a second direction of the printing medium.

Each of the printing head units is positioned on a top edge portion of the printing medium along a second direction thereof so that the large-format image is divided into a plurality of elongated printing zones along a first direction of the printing medium.

The driving head units can be driven to move in a first direction by a screw nut mechanism.

The large-format inkjet printing apparatus further comprises a servo control system connected to the printing head units for controlling a movement thereof.

Each of the printing head units is arranged to be individually moved along the first direction.

Each of the printing head units can also arranged to be moved along the first direction in a synchronized manner.

The large-format printing apparatus further comprises a medium suction device for adjusting a distance between the printing medium and the printing head units.

The large-format printing apparatus further comprises a plurality of maintenance devices provided on the printing head units for providing regular maintenance to the printing nozzles of the printing head units respectively. Each of the maintenance devices comprises a cover unit for selectively covering the corresponding printing nozzle, an ink absorption device for absorbing the air and the residual ink staying in the corresponding printing nozzle when the printing nozzle is not in use to ensure the printing effect, an ink removal device arranged to remove residual ink every time the printing nozzle is used for printing and restores to its original position, and an ink discharge device for allowing residual ink from the process of ink absorption and ink removal to be discharged out of the corresponding printing head unit.

The large-format printing apparatus further comprises an ink supplying system arranged to withdraw ink from a main ink supply tank and continuously supply ink to ink cartridges of the individual printing head units. The ink supplying system comprises an ink delivering system and a pressure adjustment device arranged to generate a predetermined pressure for allowing the corresponding printing nozzle to have an optimal ink pressure for printing, wherein when the printing nozzle is not in use, the ink pressure is suitably and optimally adjusted so as to prevent the printing nozzle from being blocked by ink residual.

The large-format printing apparatus further comprises a medium suction device adapted for sucking the printing medium when the printing head units print thereon.

The large-format inkjet printing apparatus further comprises an image division device for recovering distorts when sub-images are spliced into a large-format printing image.

The present invention also provides a large-format inkjet printing apparatus, comprising:

a printing medium driving unit for driving a printing medium to move periodically and steppingly in a first direction, a plurality of printing head units, wherein each of the printing head units comprises a printing nozzle arranged to move reciprocationly in a second direction for printing on a printing medium within an interval between two steps of the movement of the printing medium in the first direction, wherein the first direction is perpendicular to the second direction, wherein the printing head units are positioned at one end portion of the printing medium, while the printing head units are arranged to print on a predetermined printing zone to form a sub-image, wherein each of the sub-images is arranged to be spliced with the adjacent sub-image to form a complete large-format printing image.

The present invention also provides a method of printing on a large-format printing medium, comprising the steps of: driving a plurality of printing head units to move periodically and steppingly in a first direction, wherein each of the printing head units comprises a printing nozzle, driving the printing nozzles to move in a second direction for printing a sub-image on the printing medium within an interval between two steps of the movement of the printing head units in the first direction, wherein the first direction is perpendicular to the second direction, and repeating the above steps and splicing seamlessly with the sub-images to form a complete large-format printing image.

The present invention further provides a method of printing on a large-format printing medium, comprising the steps of: driving a printing medium to move periodically and steppingly in a first direction, driving a plurality of printing head units to move in a second direction within an interval between two steps of the movement of the printing medium moving in the first direction for printing on the printing medium, wherein the first direction is perpendicular to the second direction, and repeating the above steps and splicing seamlessly with the sub-images to form a complete large-format printing image.

DETAILED DESCRIPTION OF THE PREFERRED EMBODIMENT

The large-format printing apparatus described in the following embodiment is a large-format inkjet printing apparatus which is capable of printing on a printing medium made of any material and of any thickness. Moreover, the large-format printing apparatus is capable of selectively performing black-and-white or color printing.

Figure 1:
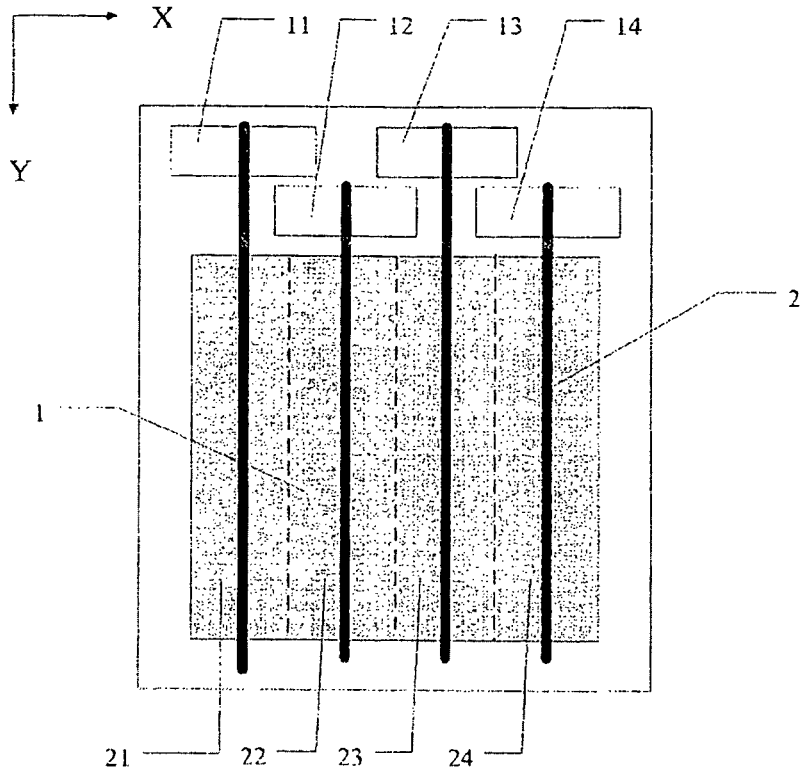
FIG. 1 is a schematic diagram of working principles of a large-format printing apparatus according to a first preferred embodiment of the present invention.

The large-format inkjet printing apparatus comprises a plurality of printing head units each of whose nozzles are capable of sliding reciprocatingly along a sliding frame in the X-direction as shown in FIG. 1 of the drawings.

The large-format printing apparatus utilizes the sliding movement of the printing head units along X-direction for accomplishing large-format printing. A feature of the present invention is that the printing head units or the printing medium can move reciprocatingly along the Y-direction indicated in FIG. 1 of the drawings.

The description below utilizes four printing head units used for A4 sized printing mediums to print an A1 sized printing medium. A size of the A4 printing medium is 210 mm×297 mm, while a size of an A1 printing medium is 841 mm×594 mm. The embodiments described below are for exemplary purposes and do limit the scope of the present invention. The large-format inkjet printing apparatus can be used for making large-format printing image having any size, any resolution and using any number of printing head units.

Embodiment 1

Figure 2:
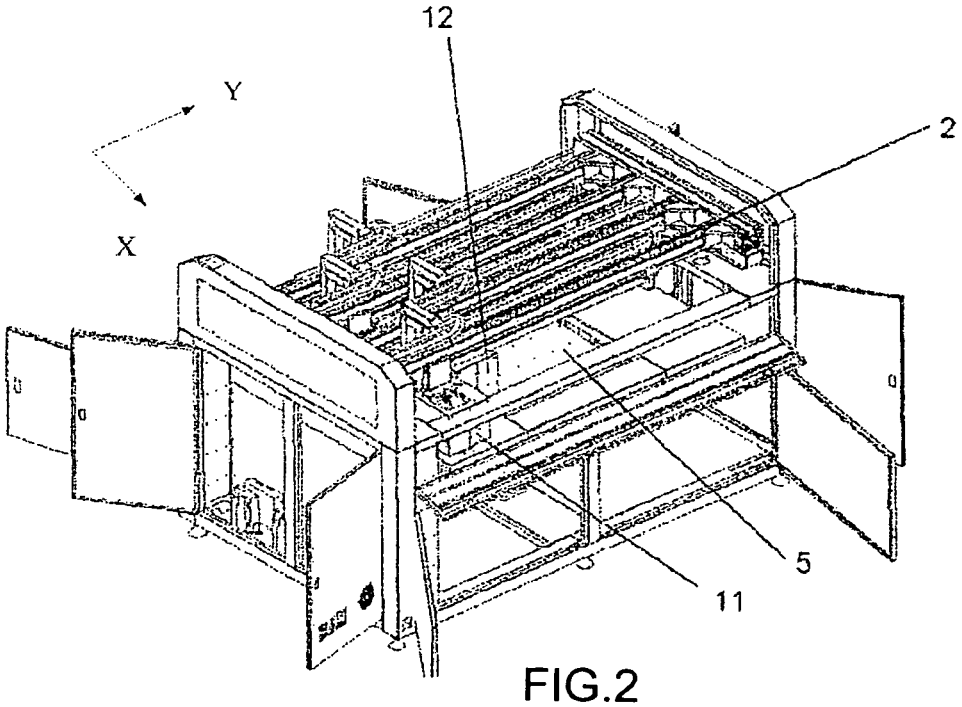
FIG. 2 a perspective view of the large-format printing apparatus according to the above first preferred embodiment of the present invention.

Referring to FIG. 1 to FIG. 2 of the drawings, a large-format inkjet printing apparatus according to a first preferred embodiment of the present invention is illustrated, in which the large-format inkjet printing apparatus comprises a plurality of printing head units 11, 12, 13, 14 spacedly positioned on a predetermined printing medium in such a manner that each of the printing head units 11, 12, 13, 14 is initially disposed at an end portion of the printing medium along a Y-direction. Moreover, each two adjacent printing head units 11, 12, 13, 14 are arranged to be dis-aligned along X-direction so that when each of the printing head units 11, 12, 13, or 14 is actuated to perform printing, it will not hit any of the adjacent printing head units 11, 12, 13, or 14 as a result. This arrangement also ensures that the printing produced by each of the printing head units 11, 12, 13, 14 through a corresponding printing nozzle 8 matches seamlessly with the printing produced by any of the adjacent printing head units 11, 12, 13, or 14 along an X-direction. According to the first preferred embodiment of the present invention, the printing head units 11, 12, 13, 14 are driven by a driving unit 2 to move along the Y-direction, whereas each of the printing head units 11, 12, 13, 14 comprises a printing nozzle 8 movably provided on the corresponding printing head units 11, 12, 13, 14 and are arranged to move along the X-direction indicated in FIG. 1 of the drawings.

In order to ensure that each of the printing head units 11, 12, 13, 14 does not interfere with each other, the movement of each of the printing head units 11, 12, 13, 14 along the Y-direction and the movement of each of the printing nozzles 8 along the X-direction are individually controlled so that the printing head units 11, 12, 13, 14 do not necessarily move in a synchronized manner.

As an example for printing an A1 size document, when the large-format inkjet printing apparatus starts printing, a control module thereof is arranged to divide the A1 size printing medium into four printing zones 21, 22, 23, 24, and command the printing head units 11, 12, 13, 14 to print the material onto the four printing zones 21, 22, 23, 24 respectively. In other words, the data of the entire graphics which is to be printed on the A1 size printing medium is divided into four sets of sub-data corresponding to the graphics which are to be printed on the four printing zones 21, 22, 23, 24 respectively. The four sets of sub-data are printed on the four printing zones 21, 22, 23, 24 by the four printing head units 11, 12, 13, 14 respectively.

Figure 4:
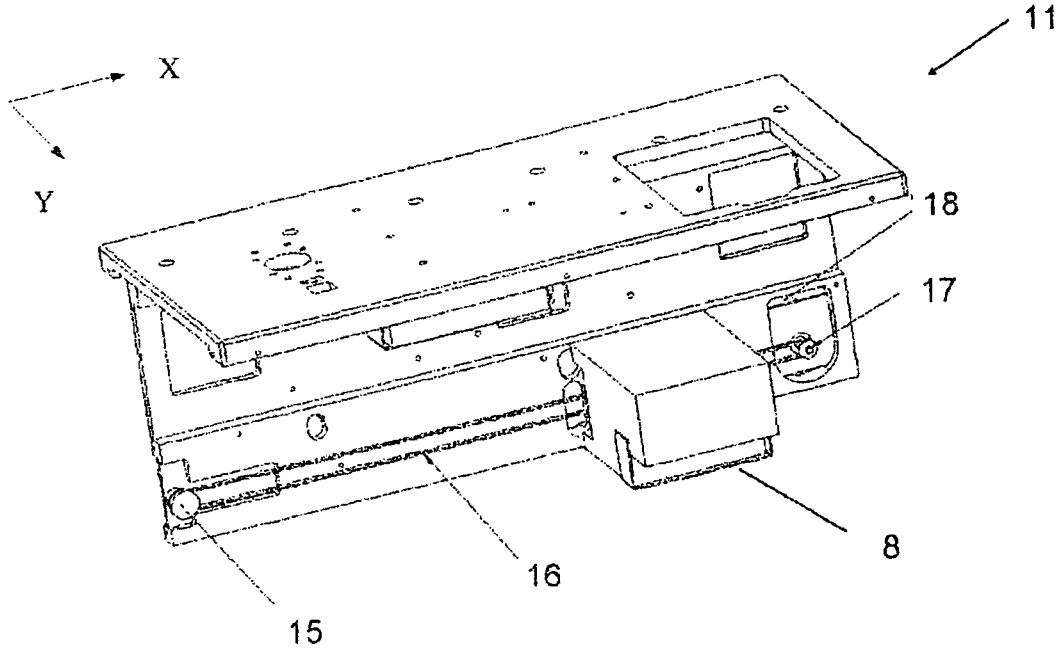
FIG. 4 is an internal structure diagram of the printing head unit of the large-format printing apparatus according to the above first preferred embodiment of the present invention.

When each of the printing head units 11, 12, 13, 14 receives the printing command initiated by the control module, the printing head units 11, 12, 13, 14 are independently driven by the driving unit to move periodically and steppingly along the Y-direction while the printing nozzles 8 of each of the printing head units 11, 12, 13, 14 is arranged to move and print along the X-direction. Take one of the printing head units 11 as an example, as shown in FIG. 4 of the drawings, the printing head unit 11 comprises a driving motor 18, a plurality of driving shafts 15, 17, and a transmission belt 16 engaging with the corresponding printing nozzle 8 in such a manner that the driving motor 18 is arranged to drive the printing nozzle 8 to move periodically along X-direction through the driving shafts 15, 17 and the transmission belt 16. When the printing nozzle 8 moves in X-direction, the printing nozzle 8 is arranged to controllably eject a predetermined amount of ink onto the printing medium so as to print onto the corresponding printing zone.

When the printing head units 11, 12, 13, 14 finish printing for a particular position (i.e. coordinate) in Y-direction, each of the printing nozzles 8 is arranged to return to its initial position in X-direction. Then the printing head units 11, 12, 13, 14 are arranged to move steppingly in Y-direction and the printing nozzles 8 are arranged to be driven to move in X-direction again for printing on another row on the printing medium because the printing head units 11, 12, 13, 14 are now moved to a new position in Y-direction. The printing head units 11, 12, 13, 14 can move along the entire length of the printing zones along the Y-direction, while the printing nozzles 8 are arranged to print on the relevant printing zones of the printing medium in X-direction. When the printing head units 11, 12, 13, 14 finish printing on the entire printing medium, the printing nozzles 8 and the printing head units 11, 12, 13, 14 are arranged to return to their original positions respectively.

Preferably, each of the printing head units 11, 12, 13, 14 can be embodied as the printing head units for conventional small-format printers.

One distinctive feature of the present invention is that for conventional small-format printers, the printing head units do not move in Y-direction. Rather, in order to accomplish a particular printing job, it is the printing medium that moves in Y-direction. In such situation, for a conventional small-format printer to print a page of document, the printing head unit needs to print the entire graphics in a row-by-row manner. The printing head unit needs to finish a row of printing and wait for the printing medium to move before it can start printing another row of graphics or document, and this essentially constitutes a two-dimensional scan for the entire printing medium by the printing head unit. In the present invention, however, the printing head unit 11, 12, 13, 14 move in Y-direction instead of the movement of the medium.

Figure 3:
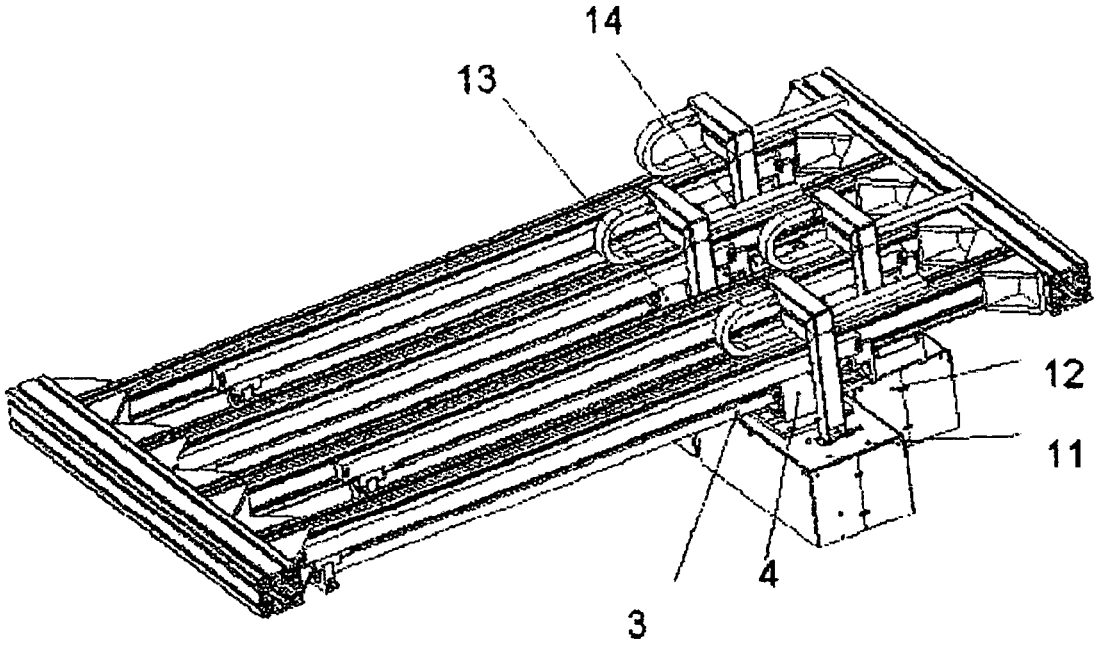
FIG. 3 is a perspective view of a printing head unit of the large-format printing apparatus according to the above first preferred embodiment of the present invention.

Referring to FIG. 3 of the drawings, the large-format inkjet printing apparatus comprises a plurality of driving units 2 connected to the printing head units 11, 12, 13, 14 respectively for driving a movement thereof respectively. More specifically, the driving unit 2 is a screw-nut mechanism, each of the driving units 2 comprises a threaded rod 3 and a bolt nut control base 4 which is mounted on the corresponding printing head unit 11, 12, 13, 14. The corresponding printing head unit 11, 12, 13, 14 on a lead rail is hung underneath the threaded rod 3. The printing head unit 11, 12, 13, 14 are driven to move in Y-direction along a corresponding guiding track through a rotational movement of the corresponding threaded rod 3. Moreover, the large-format inkjet printing apparatus further comprises a server control system for finely controlling a rotational movement of the threaded rods 3 of the driving units 2. It is important to mention that this server control system may also fine and precise control of the movement of the threaded rods 3 so as to precisely control the movement of the printing head unit 11, 12, 13, 14. When the movements of printing head units 11, 12, 13, 14 are precisely and finely controlled, the printing resolution thereof along Y-direction can be greatly enhanced.

In the present invention, it is necessary to perform image processing as an image recovery device. Since the present invention prints the entire image or graphics by dividing it into printing zones, the image processing requires representing the entire image into a two dimensional array and divide it into a plurality of sub-images. When the image is divided and individually printed, image stitching is necessary. Since the lead rails has tolerance, the edge portions of each of the sub-images may be overlapped with adjacent sub-image, suffer image distortions, or misalignment. As a result, image processing software is needed to adjust the edge portions of the sub-images so as to tackle and remove the distortion or alignment problems and make a seamless image. The image processing software is also needed to provide image correction function, image enhancement function, image restoration function, image analysis function, and image identification function etc.

Figure 5:
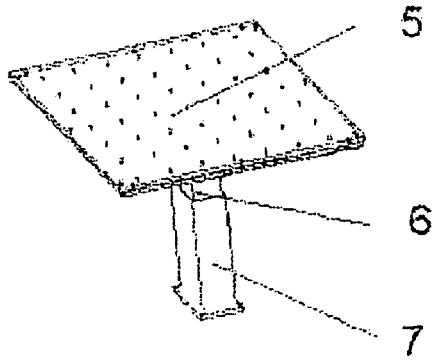
FIG. 5 is a schematic diagram of a medium suction device of the large-format printing apparatus according to the above first preferred embodiment of the present invention.
Figure 6:
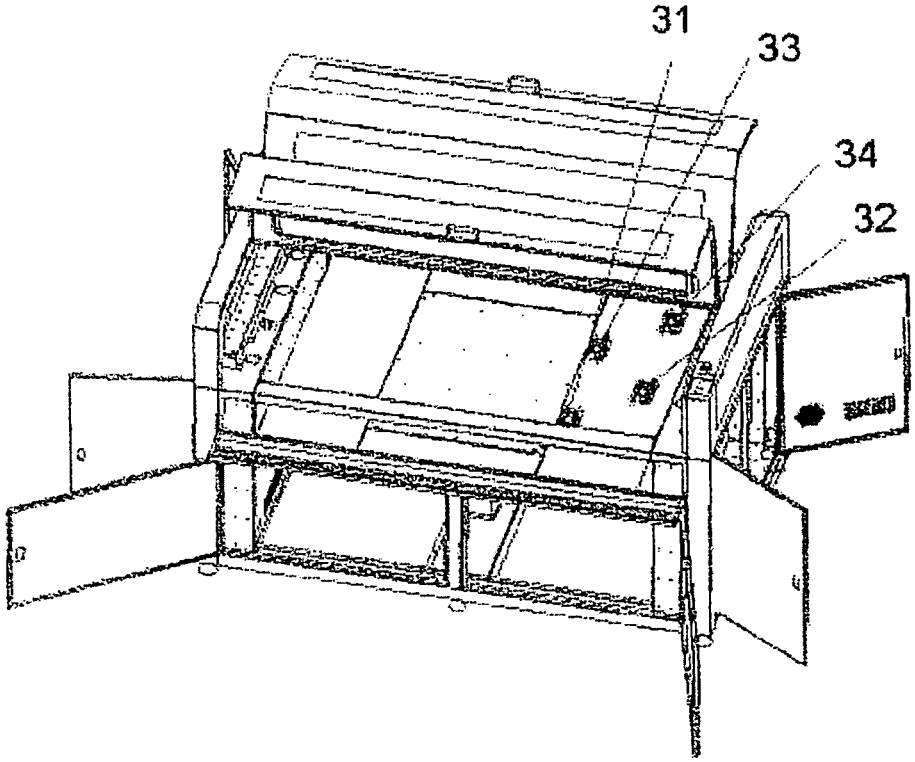
FIG. 6. is a schematic diagram of a maintenance device of the large-format printing apparatus according to the above first preferred embodiment of the present invention.

Referring to FIG. 5 of the drawings, the large format inkjet printing apparatus further comprises a medium suction device which is mounted underneath the printing head units, and comprises a supporting shaft 7 mounted on a supporting frame of the large format inkjet printing apparatus, a loading platform 5, and a movable part 6 movably extended between the loading platform 5 and the supporting shaft 7. The loading platform 5 is arranged to support the printing medium, and is driven to move upwardly for allowing the printing medium to be printed by the printing head units, and downwardly for allowing a user to access and replace the printing medium on the loading platform 5. Moreover, the loading platform 5 has a plurality of air holes spacedly formed thereon, wherein the loading platform 5 is also connected to a pumping device (not shown in the figure) so that negative pressure is developed on the loading platform 5 through the air holes for sucking tightly the printing medium to stay on the loading platform 5 when the large format inkjet printing apparatus of the present invention is operated to print on the printing medium. Since the printing medium is kept on the loading platform 5 in a flat manner, the printing medium is prevented from forming wrinkles caused by soaking an excessive amount of ink from the printing head units.

Figure 7:
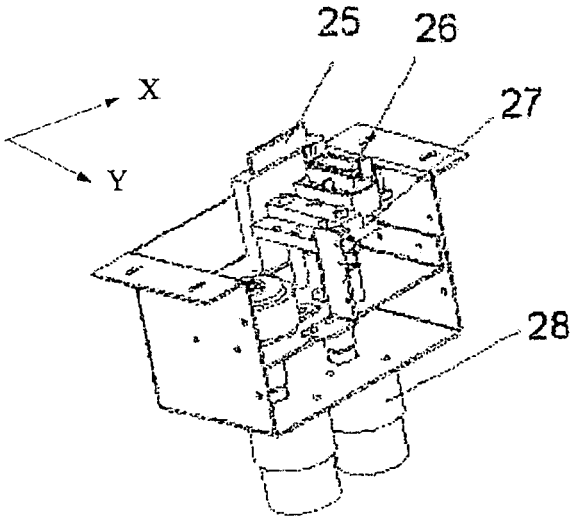
FIG. 7 is an internal structure diagram of the maintenance device of the large-format printing apparatus according to the above first preferred embodiment of the present invention.

The large-format inkjet printing apparatus further comprises a plurality of maintenance devices 31, 32, 33, 34 provided on the printing head units 11, 12, 13, 14 for providing regular maintenance to the printing nozzles 8 of the printing head units 11, 12, 13, 14 respectively when they are not in use. Referring to FIG. 7 of the drawings, each of the maintenance devices 31, 32, 33, 34 comprises a cover unit 26 and a actuation unit 28 mounted underneath the cover unit 26 for selectively moving the cover unit 26 to cover the corresponding printing nozzle 8 when the printing nozzle 8 is not in use for printing. The cover unit 26 shields the corresponding printing nozzle 8 from the ambient environment so as to prevent dusts or other external object from interfering with the printing nozzle 8 when it is not in use. Each of the maintenance devices 31, 32, 33, 34 further comprises an ink absorption device 27 provided underneath the corresponding cover unit 26 for absorbing residual ink staying on the corresponding printing nozzle 8 when it is not in use, an ink removal device 25 arranged to remove any residual ink every time the printing nozzle 8 is used for printing and restore to its original position in Y-direction, and an ink discharge device for allowing residual ink to be discharged out of the corresponding printing head unit 11, 12, 13, 14.

More explicitly, the ink absorption device 27 is used when the printing head units 11, 12, 13, 14 have not been used for a period of time and ink residual is disposed on and block the printing nozzle 8. When the printing head unit needs ink absorption, the printing nozzle 8 is moved to align with the ink absorption device 27. Moreover, the corresponding cover unit 26 is moved upwardly to align tightly with an end surface of the printing nozzle 8 to be an enclosed environment, whereas the ink absorption device 27 comprises a pumping device for sucking the ink from the printing nozzle 8 when it is aligned with the ink absorption device 27. When the ink absorption device 27 finishes sucking the ink, the cover unit 26 moves downwardly to allow the printing nozzle 8 to be aligned with the ink removal device 25. The corresponding printing nozzle 8 is then activated to slide through the ink removal device 25 while the ink removal board is arranged to remove any ink residual staying on the printing nozzle 8.

Figure 8:
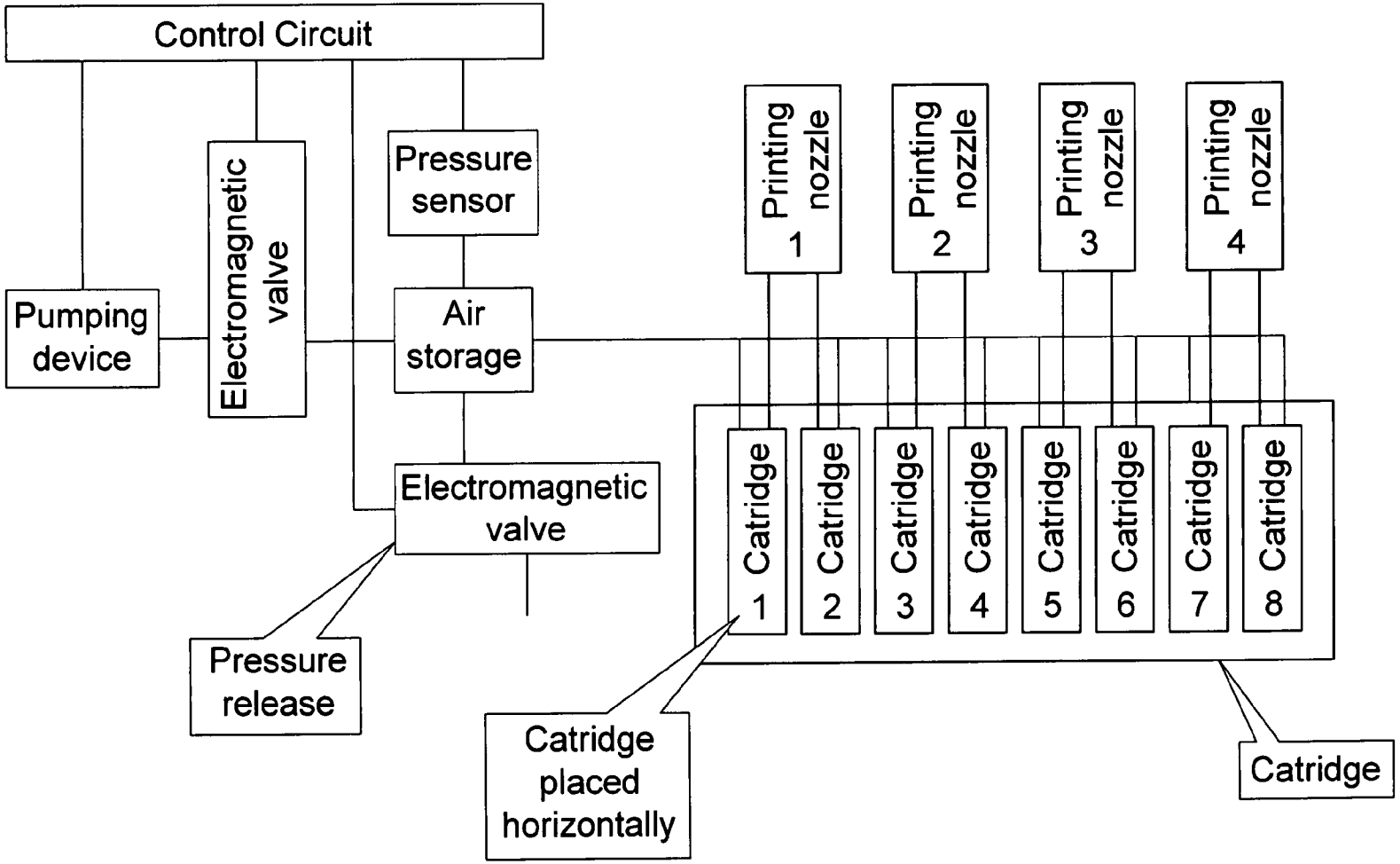
FIG. 8 is a schematic diagram of an ink supplying system of the large-format printing apparatus according to the above first preferred embodiment of the present invention.

Referring to FIG. 8 of the drawings, since the large-format inkjet printing apparatus requires large amount of ink for printing, it further comprises an ink supplying system arranged to withdraw ink from a main ink supply tank and continuously supply ink to the individual printing head units 11, 12, 13, 14. The ink supplying system comprises an ink delivering system and a pressure adjustment device arranged to generate a predetermined pressure for allowing the corresponding printing nozzle 8 to have an optimal ink pressure for printing. When the printing nozzle 8 is not in use, the ink pressure is suitably and optimally adjusted so as to prevent the printing nozzle 8 from being blocked by ink residual.

The large-format inkjet printing apparatus further comprises a plurality of ink cartridges provided underneath the printing nozzles 8, wherein the ink stored in the ink cartridges is pumped by a pressure device to the printing nozzle 8. Since the ink cartridges are positioned underneath the printing nozzle 8, the supply of ink to the printing nozzle 8 is more stable, while leakage of ink from the ink cartridges can be effectively prevented. Moreover, each of the ink cartridges are horizontally positioned and in a landscape manner for maximizing a stability of ink supply to the printing nozzles 8.

Embodiment 2

Figure 9:
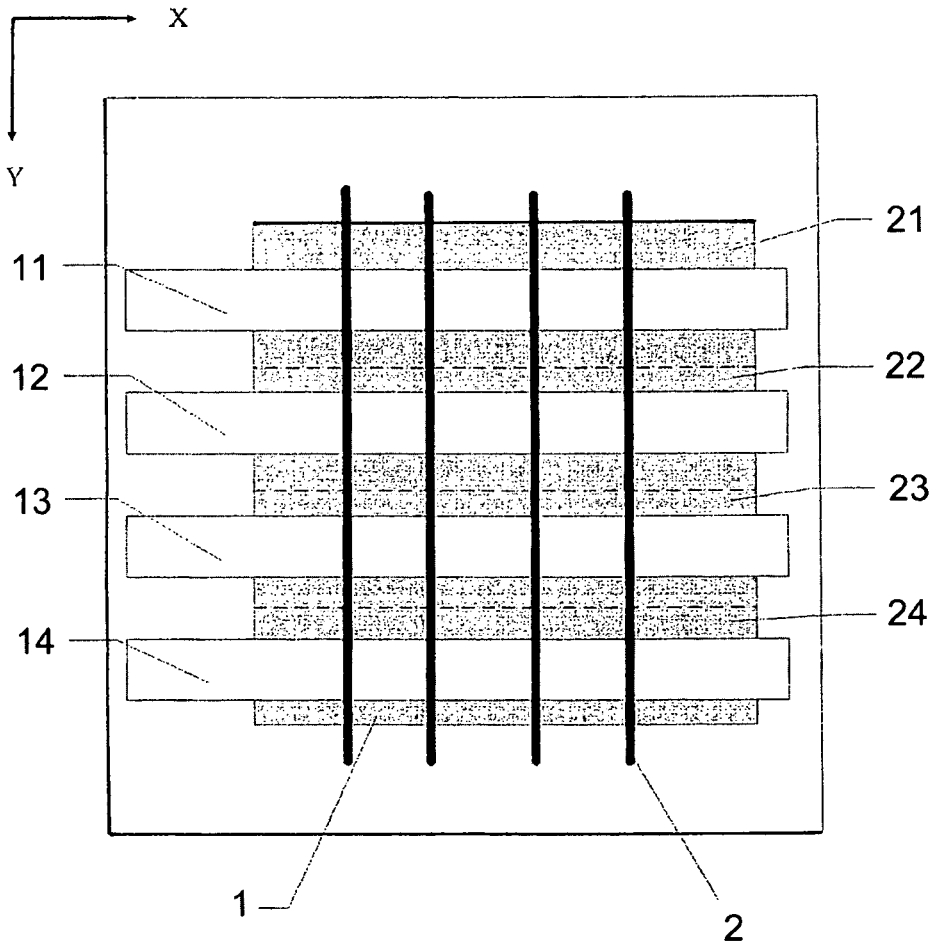
FIG. 9 is a schematic diagram of working principles of a large-format printing apparatus according to a second preferred embodiment of the present invention.

In the first embodiment disclosed above, the printing medium is divided into four printing zones along a longitudinal direction of the printing medium. As shown in FIG. 9 of the drawings, in this second preferred embodiment of the present invention, the printing medium is divided into four printing zones 21, 22, 23, 24 along a transverse direction of the printing medium. The movement of the printing head units 11, 12, 13, 14 and the printing nozzles 8 are identical to that disclosed in the first preferred embodiment, that is, the printing head units 11, 12, 13, 14 move steppingly in Y-direction while the printing nozzles 8 print in X-direction. This arrangement enhances a printing width of the large-format inkjet printing apparatus of the present invention. For example, the printing apparatus may easily and conveniently print on a printing medium of A1 size.

It is important to mention that the actuation of the printing head units 11, 12, 13, 14 can substantially enhance the printing speed of the present invention. Each of the four printing head units 11, 12, 13, 14 (FIG. 9 of the drawings) can be individually controlled and driven to move for printing by separate driving units. However, as described in the third embodiment of the present invention below, the printing head units can also be driven by a single driving unit.

Apart from all these, the second preferred embodiment is similar to the first preferred embodiment.

Embodiment 3

Figure 10:
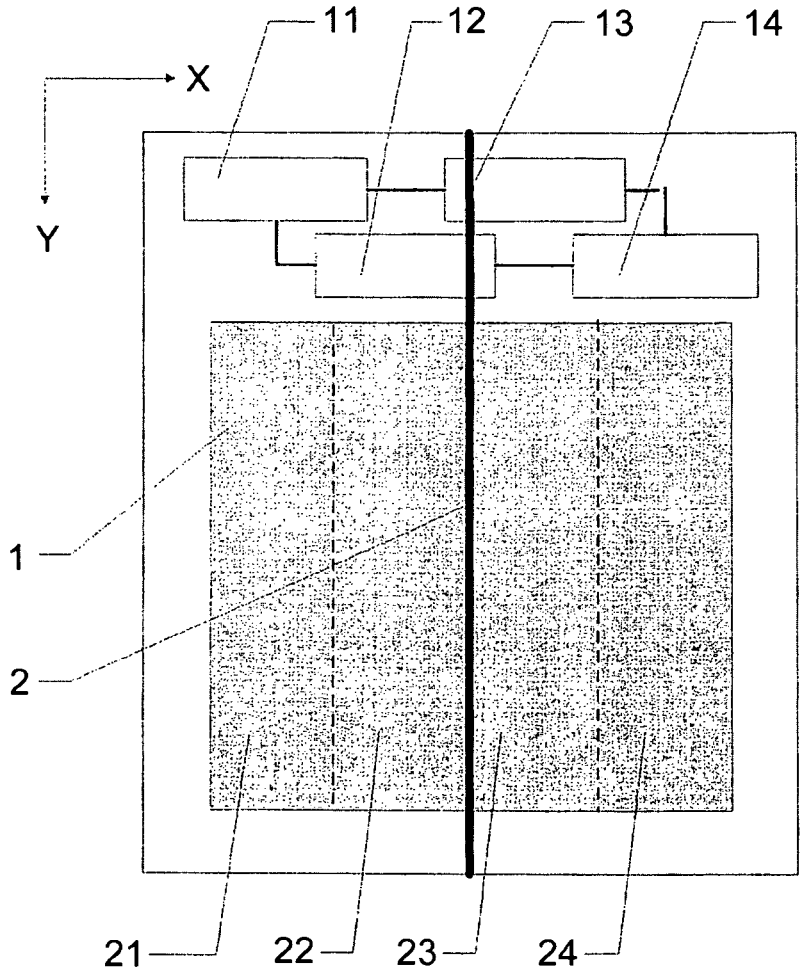
FIG. 10 is a schematic diagram of working principles of a large-format printing apparatus according to a third preferred embodiment of the present invention.

In this third preferred embodiment, the four printing head units 11, 12, 13, 14 are all driven by a single driving unit and are driven to move in a synchronized manner along Y-direction, as shown in FIG. 10 of the drawings.

In the first preferred embodiment, the printing head units 11, 12, 13, 14 are individually driven by four different driving units to move, wherein they are positioned to ensure that each of the printing head units 11, 12, 13, 14 does not hit or affect adjacent printing head unit.

In this third preferred embodiment, the four printing head units 11, 12, 13, 14 are driven by one driving unit in a synchronized manner so that they are driven to move in Y-direction when all printing nozzles 8 finish printing in X-direction. In this third preferred embodiment, it is impossible for the four printing head units 11, 12, 13, 14 to hit adjacent printing head units 11, 12, 13, 14.

Apart from all these, the third preferred embodiment is similar to the first preferred embodiment.

Embodiment 4

In this fourth preferred embodiment, the printing nozzles 8 of the printing head units 11, 12, 13, 14 are individually driven to move along X-direction for printing. However, the printing head units 11, 12, 13, 14 do not move and are kept stationary. In order to accomplish a flow line printing, the printing medium is driven to move along Y-direction, preferably by a printing medium driving unit.

Apart from all these, the third preferred embodiment is similar to the first preferred embodiment.

The large-format inkjet printing apparatus of the present invention utilizes zonal printing and combines individual printings on printing zones to achieve large-format printing on a printing medium. The present invention has the following advantages and distinctive features:

(1) The present invention utilizes zonal printing technique and divides an entire image into many sub-images. A user, depending on his or her printing need, may utilize the present invention to print an image of any size.

(2) The printing head units print simultaneously so as to substantially enhance the printing speed of the present invention.

(3) The present invention utilizes printing head units for small area printers, and effectively resolves the problem of requiring large recording unit in large area printing. Requiring large recording unit for printing apparatus leads to complicated and expensive manufacturing costs and design complexity to manufacturers.

(4) Since the resolution of each of the printing head units can be as high as 5760 dpi×1440 dpi, the present invention can therefore achieve a resolution which is substantially identical to the resolution provided by each printing head unit, and this substantially enhance the overall resolution for large area printing. The use of the screw-nut mechanism and servo motor also increase the overall resolution of the large area printing.

One skilled in the art will understand that the embodiment of the present invention as shown in the drawings and described above is exemplary only and not intended to be limiting. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A large-format printing apparatus, comprising:

a control system; and a plurality of printing head units spacedly positioned along a second direction and controlled by said control system to move in a first direction, wherein each two of said adjacent printing head units are dis-aligned along said second direction, wherein said control system is configured to individually drive said printing head units to move periodically and steppingly in said first direction, wherein each of said printing head units comprises a printing nozzle being moved reciprocatingly in said second direction for printing on a printing medium within an interval between two steps of the movement of said printing head units in said first direction, wherein said first direction is perpendicular to said second direction, wherein said printing head units are positioned at one end portion of said printing medium for printing on a predetermined printing zone to form a sub-image that said sub-images are combined seamlessly to form a large-format printing image.

2. The apparatus, as recited in claim 1, further comprising a plurality of maintenance devices to provide regular maintenance on said printing head units for providing regular maintenance to said printing nozzles of said printing head units respectively when the apparatus is not in use.

3. The apparatus, as recited in claim 2, wherein each of said maintenance devices comprises: a cover unit for selectively covering said corresponding printing nozzle completely in an enclosed environment; an ink absorption device for absorbing the air or the residual ink staying in said corresponding printing nozzle when said printing nozzle is either not in use or blocked; an ink removal device arranged to remove residual ink every time said printing nozzle is used for printing and restores to its original position; and an ink discharge device for allowing residual ink from ink absorption and ink removal to be discharged out of said corresponding printing head unit.

4. The apparatus, as recited in claim 1, further comprising an ink supplying system for withdrawing ink from a main ink supply tank and continuously supply ink to ink cartridges of said individual printing head units.

5. The apparatus, as recited in claim 4, wherein said ink supplying system comprises an ink delivering system and a pressure adjustment device arranged to generate a predetermined pressure for allowing said corresponding printing nozzle to have an optimal ink pressure for printing, wherein when said printing nozzle is not in use, said ink pressure is suitably and optimally adjusted so as to prevent said printing nozzle from being blocked by ink residual.

6. The apparatus, as recited in claim 1, further comprising a medium suction device which is mounted for sucking said printing medium in a stationary and flat manner when said printing head units print thereon.

7. The apparatus, as recited in claim 1, further comprising an image division device.

8. The apparatus, as recited in claim 1, further comprising an image recovery device for eliminating image distorting problems for the tolerance of the device when sub-images on said printing zones are spliced.

9. The apparatus, as recited in claim 1, wherein each of said printing head units is a printing head unit of a small-format printing apparatus.

10. The apparatus, as recited in claim 1, wherein each of said printing head units is positioned on an edge portion of said printing medium along said first direction thereof so that said large-format printing image is divided into a plurality of elongated printing zones along said second direction of said printing medium.

11. The apparatus, as recited in claim 1, further comprising a plurality of driving units connected to said printing head units respectively for driving a movement thereof respectively, wherein each of said driving units comprises a threaded rod and a bolt nut control base which is mounted on said corresponding printing head unit, wherein each of said printing head units on a lead rail is hung underneath said corresponding threaded rod, wherein said printing head units are driven to move in said first direction along a corresponding guiding track through a rotational movement of said corresponding threaded rod.

12. The apparatus, as recited in claim 11, wherein each of said driving units comprises a driving motor, a plurality of driving shafts, and a transmission belt engaged with said printing nozzle, wherein said driving motor is configured to drive said printing nozzle to move periodically along said direction through said driving shafts and said transmission belt.

13. A method of printing on a large-format printing medium, comprising the steps of:

driving a plurality of printing head units to move individually, periodically, and steppingly in a first direction, wherein each of said printing head units comprises a printing nozzle, wherein said printing head units are spacedly positioned along a second direction that each two of said adjacent printing head units are dis-aligned along said second direction, wherein said first direction is perpendicular to said second direction;

driving said printing nozzles to reciprocate in said second direction for printing a sub-image on said printing medium; and repeating said above steps and seamlessly combining said sub-images to form a large-format printing image.

* * * * *